US009604817B2

(12) United States Patent
Gotti et al.

(10) Patent No.: US 9,604,817 B2
(45) Date of Patent: Mar. 28, 2017

(54) STOCK-CONTROLLING METHOD FOR A STORAGE YARN FEEDER WITH ROTARY DRUM

(71) Applicant: L.G.L. ELECTRONICS S.P.A., Gandino (IT)

(72) Inventors: Luca Gotti, Albino (IT); Pietro Zenoni, Leffe (IT)

(73) Assignee: L.G.L. ELECTRONICS S.P.A., Gandino (IT)

( * ) Notice: Subject to any disclaimer, the term of this patent is extended or adjusted under 35 U.S.C. 154(b) by 264 days.

(21) Appl. No.: 14/620,387

(22) Filed: Feb. 12, 2015

(65) Prior Publication Data

US 2015/0225880 A1 Aug. 13, 2015

(30) Foreign Application Priority Data

Feb. 13, 2014 (IT) ..... TO2014A0118

(51) Int. Cl.
*B65H 51/22* (2006.01)
*D04B 15/48* (2006.01)

(52) U.S. Cl.
CPC ..... *B65H 51/22* (2013.01); *D04B 15/482* (2013.01); *D04B 15/486* (2013.01); *B65H 2701/31* (2013.01)

(58) Field of Classification Search
CPC .... B65H 51/22; D04B 15/482; D04B 15/486; D03D 47/367
See application file for complete search history.

(56) References Cited

U.S. PATENT DOCUMENTS 5,590,547 A 1/1997 Conzelmann
9,126,799 B2 * 9/2015 Barea ..... B65H 51/22
2003/0145899 A1 8/2003 Covelli

FOREIGN PATENT DOCUMENTS

EP 1223138 A2 7/2002
EP 2592032 A1 5/2013

OTHER PUBLICATIONS

Italian Search Report issued Oct. 30, 2014; re Application No. TO2014A000118; citing: EP 2 592 032 A1, U.S. Pat. No. 5,590,547 A, US 2003/145899 A1 and EP 1 223 138 A2.

* cited by examiner

*Primary Examiner* — William E Dondero
(74) *Attorney, Agent, or Firm* — Cantor Colburn LLP

(57) ABSTRACT

A yarn feeder is provided with a drum which is driven to rotate by a motor controlled by a control unit for drawing yarn from a reel and winding it upon itself in the shape of loops forming a stock. The control unit estimates the stock on the drum on the basis of an information indicative of the amount of yarn which is unwound from the drum upon request from a downstream machine, and of an information indicative of the amount of yarn which is wound on the drum, and retroactively controls the motor to substantially stabilize the stock on a reference value. The control unit also performs a parallel correction routine in which compares the stock with the reference value to estimate a stock status RES<REF_RES or RES≥REF_RES, wherein RES is the estimated stock and REF_RES is the reference value.

6 Claims, 2 Drawing Sheets

STOCK-CONTROLLING METHOD FOR A STORAGE YARN FEEDER WITH ROTARY DRUM

CROSS REFERENCE TO RELATED APPLICATIONS

This application is related to and claims the benefit of Italian Patent Application No. TO2014A000118, filed on Feb. 13, 2014, the contents of which are herein incorporated by reference in their entirety.

TECHNICAL FIELD

The present disclosure relates to a stock-controlling method for a storage yarn feeder with rotary drum.

The present disclosure relates to a stock-controlling method for a storage yarn feeder with rotary drum.

BACKGROUND

In a conventional textile process, the yarn may be fed to a textile machine, e.g., a circular knitting machine, by a plurality of so-called "storage" yarn feeders. A storage yarn feeder is generally provided with a drum having a plurality of yarn loops wound thereon, which are adapted to be unwound upon request from the downstream machine As the yarn is unwound from the drum, it may be re-loaded either by a motorized swivel arm rotating about an axis coaxial with the axis of the drum, or, in the case of feeders considered here, by driving the drum to rotate, which drum, in this case, must be motorized.

During the feeding process, it is very important to maintain the amount of yarn stored on the drum substantially constant on an optimum level, as well as to maintain the loops regularly spaced from each other. In fact, a reduction of the stock below an optimum level would cause the yarn tension to rise excessively, resulting in defects in the finished product. In extreme cases of a stock reduced to zero, the downstream machine would start drawing yarn directly from the reel, which circumstance would cause unacceptable peaks of tension. On the contrary, a growth of the stock above an optimal level would cause the yarn to accumulate at the delivery end of the drum, with the yarn loops overlapping unevenly and consequent anomalies in the feeding process.

Such phenomena are very difficult to be controlled, particularly when the feeders are installed on large-in-diameter circular knitting machines, which may have even more than sixty feeders installed thereon.

In order to limit the above drawbacks, it is known to control the amount of stock on the drum.

A simple control method consists of providing the feeder with sensor means, e.g., optical sensors or mechanical sensors, which are adapted to provide a binary information about the presence/absence of yarn at a predetermined area of the drum. The rotation of the drum is controlled on the basis of the signals generated by the above sensor means in such a way as to maintain the stock on the drum within the monitored area.

The above control system, which is based on a binary information about the presence/absence of yarn in a monitored area of the drum, allows the tension of the yarn delivered by the drum to be controlled only approximatively, because the stock oscillates continuously within a predetermined range with a relatively high amplitude. This circumstance inevitably affects the regularity of the yarn-feeding process and, consequently, the quality of the finished tissue.

More sophisticated control systems are also known, in which the amount of stock on the drum is estimated on the basis of an information about the number of loops which are unwound from the drum and an information about the number of loops which are wound on it, both such items of information being provided by sensor means, e.g., optical sensors, from which relative (i.e., non-absolute) items of information can be derived. A system of this type is described, e.g., in EP 2 592 032. In this case, the rotation of the motor is controlled in such a way as to maintain the amount of yarn substantially constant with respect to a predetermined amount of yarn which is wound on the drum during an initial loading procedure, which is also described in the above document.

Theoretically, the above system allows the amount of yarn stored on the drum to be controlled very accurately. However, as it is based on the comparison between two relative items of information, in the practice it has the drawback that it is vulnerable to detection errors of the sensors (which errors may be caused, e.g., by signal noise or dust in the environment). In the presence of such errors, a so-called "drift" phenomenon may occur, which is well known to the person skilled in the art, in which the stock tends to rise or diminish in an uncontrolled way (i.e., without the system noticing it and intervening by compensating the error), up to a complete emptying or overloading of the drum.

The above vulnerability is also evident in the case of a temporary interruption of the power. In fact, after the interruption, the drum will continue to rotate by inertia, thereby winding a few loops upon itself; however, this information does not reach the control system because the sensors are not powered. Therefore, as the power is restored, the control unit will start modulating without compensating this accidental increase in the stock.

SUMMARY

Therefore, it is a main object of the present disclosure to provide a stock-controlling method for a storage yarn feeder with rotary drum, which has a higher accuracy with respect to systems based on a binary information—generated by a sensor associated to the drum—about the presence/absence of stock, but is also more reliable with respect to known systems in which the stock is estimated on the basis of items of information about the loops of yarn winding/unwinding on/from the drum.

It is another object of the disclosure to provide a system which does not require an initial loading procedure, in order to simplify the process and to speed it up.

BRIEF DESCRIPTION OF THE DRAWINGS

The disclosure will be now described in more detail with reference to a few preferred, non-exclusive embodiments shown by way of non-limiting example in the attached drawings, wherein.

DESCRIPTION OF THE PREFERRED EMBODIMENTS

Figure 1:
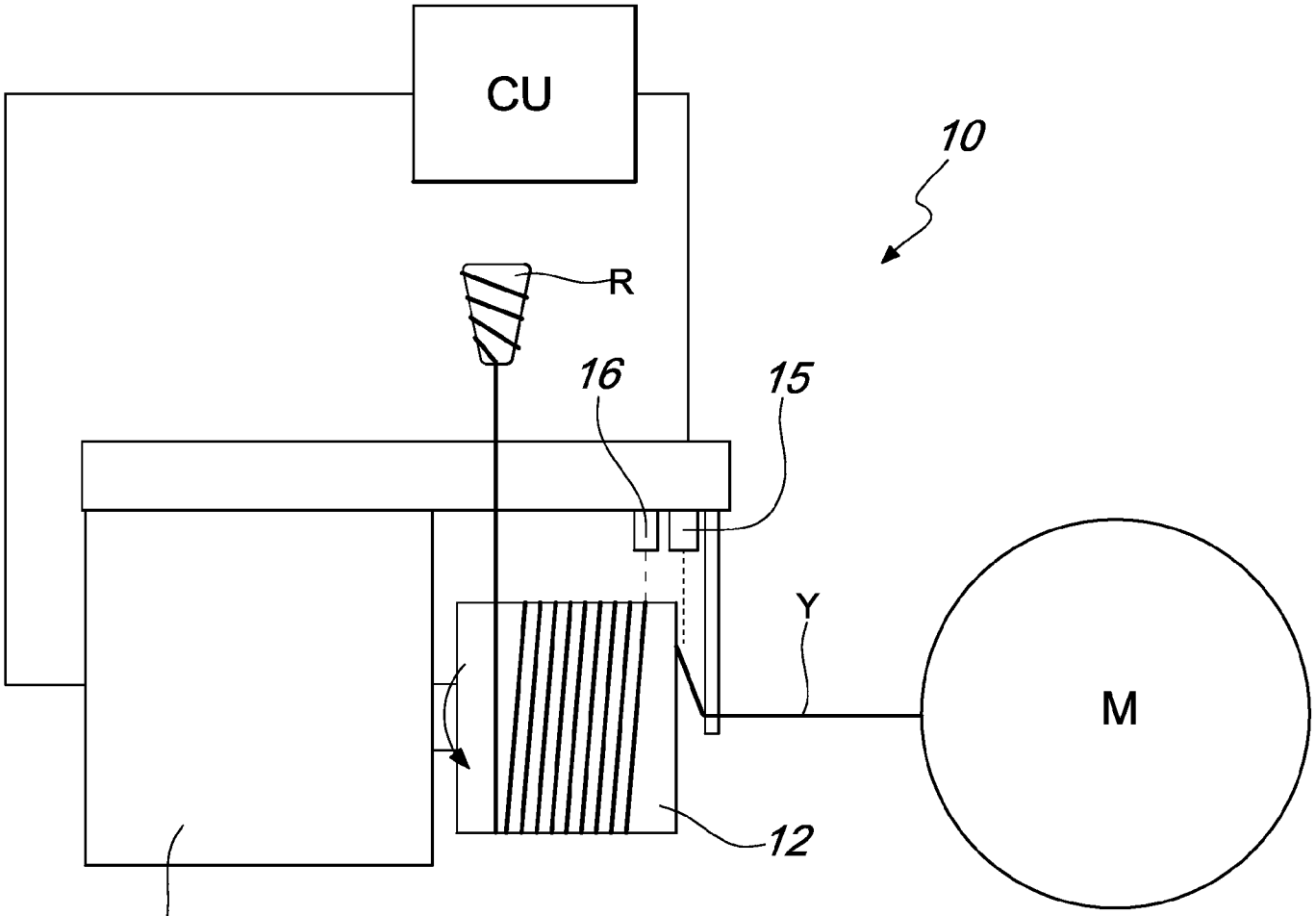
FIG. 1 is a diagrammatical view in side elevation of a storage yarn feeder of the type to which in the present disclosure refers.

With initial reference to FIG. 1, a storage yarn feeder 10 comprises a drum 12 having a plurality of loops of yarn Y wound thereon, which are adapted to be unwound upon request from general textile machine M arranged downstream. While the yarn is unwound from drum 12, the latter is driven to rotate by a motor 14 to draw fresh yarn from a reel R and wind it upon itself in the form of new loops.

A control unit CU is programmed to control motor 14 in such a way as to stabilize the stock on the drum on a predetermined, optimum level, on the basis of the method described hereinafter.

In a way known per se, the method provides estimating the stock RES stored on drum 12 on the basis of both the amount of yarn delivered, which is measured by sensor means 15 which are adapted to count the number of loops or portion of loops which are unwound from the drum, and the amount of yarn loaded, which is calculated, e.g., on the basis of the speed of rotation and/or the position of motor 14; and then, controlling by feedback the rotation of motor 14 in such a way as to maintain stock RES substantially constant and equal to a reference value REF_RES. Such control by feedback may be conventionally carried out, e.g., by a PID controller or the like, which is adapted to minimize the error RES_PID resulting from the difference between the reference value and the estimated amount, i.e.:

$$RES_PID=REF_RES-RES$$

Figure 2:
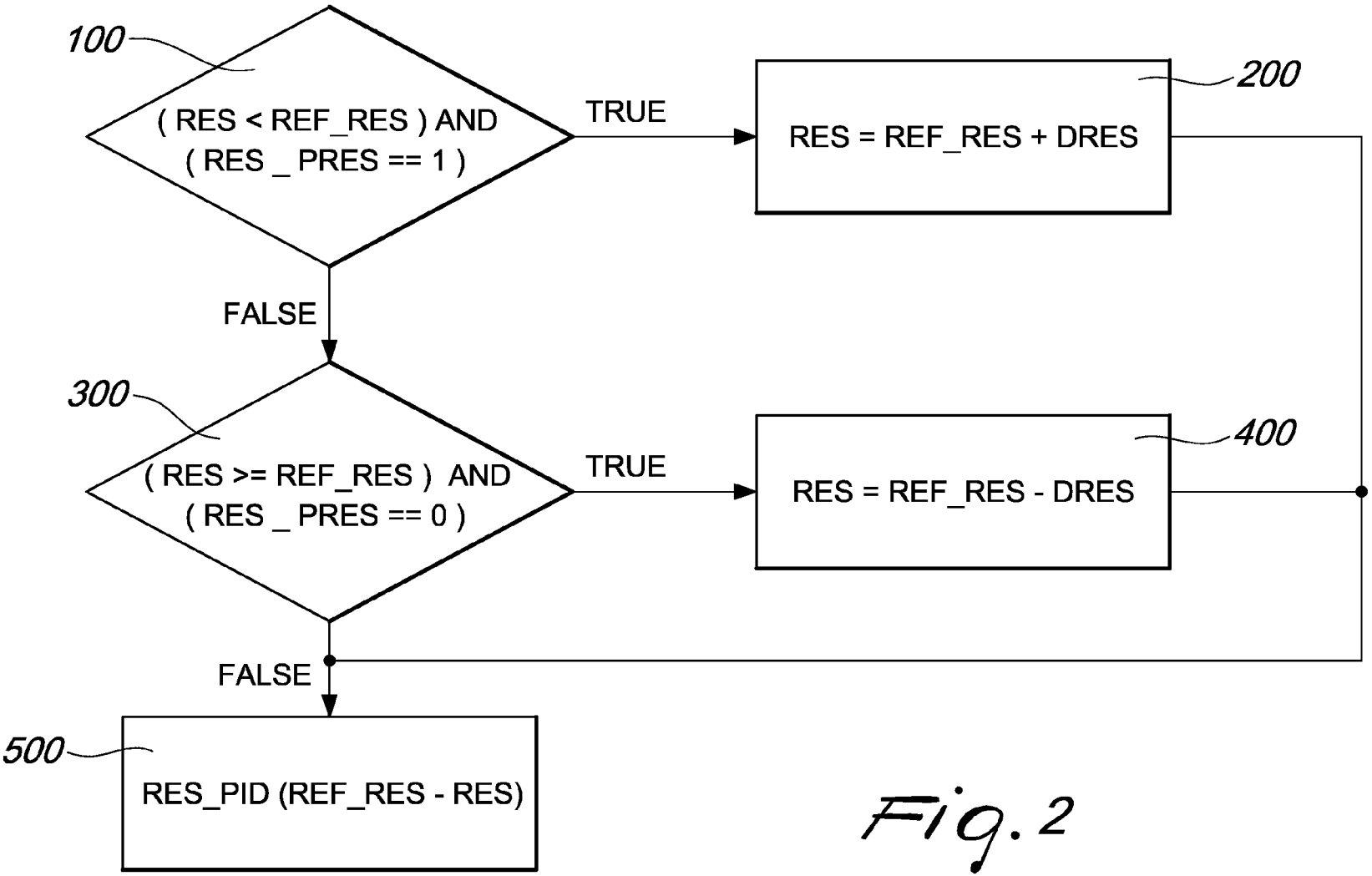
FIG. 2 is a flowchart describing the stock-controlling method according to the disclosure applied to a yarn feeder as shown in FIG. 1.

In addition, the method according to the disclosure provides performing a correction routine, parallel to the control by feedback, which is shown in FIG. 2 and comprises the steps of:

comparing the estimated amount of stock RES with the reference amount of stock REF_RES in order to obtain a stock status, i.e., $$RES<REF_RES \text{ or } RES\geq REF_RES,$$

comparing said stock status with a signal generated by presence sensor 16 associated to drum 12, which is adapted to generate an absolute binary information RES_PRES indicative of the presence/absence of yarn in a predetermined area of drum 12 delimiting an optimum stock (e.g., presence of yarn, RES_PRES=1; absence of yarn, RES_PRES=0), and in case of inconsistency of the two items of information (e.g., RES<REF_RES and RES_PRES=1 (block 100) or RES≥REF_RES and RES_PRES=0 (block 300)) correcting the estimated stock RES in such a way that the stock converges towards the area of drum 12 monitored by presence sensor 16.

The inconsistency between the calculated stock status, which results from the comparison between the estimated amount of stock RES and the reference amount of stock REF_RES, and the measured stock status, which is measured by presence sensor 16, is indicative of the fact that the feeder tends to an overloading/emptying condition which is not compensated by the control loop.

Therefore, with the method according to the disclosure, as this situation of inconsistency occurs, error RES_PID input to PID controller 500 is corrected in such a way as to compensate for such effect and avoid drift phenomena.

In particular, as shown in FIG. 2, with the correction of the amount of stock RES, a correction factor DRES is added to (block 200), or subtracted from (block 400), reference value REF_RES, depending on whether presence sensor 16 indicates presence (block 100) or absence (block 300) of yarn in the monitored area respectively.

Preferably, correction factor DRES corresponds to a single winding pulse. A winding pulse is regarded to as the minimum length of yarn which may be wound/unwound on/from the drum in a controlled and measurable way, in terms of loop or portion of a loop. For instance, with a winding sensor provided with three photoelectric cells equally-spaced about the axis of the drum, such minimum length is ⅓ of a loop.

The above situation that the amount of stock converges towards the area of the drum monitored by presence sensor 16, occurs regardless of the initial condition of the stock. Therefore, an initial loading procedure is not required.

Preferably, the correction routine operates at a frequency corresponding to the frequency of processing of the PID control loop, e.g., 100 Hz.

With an alternative embodiment of the disclosure, the estimated amount of stock RES' (blocks 200 and 400) is corrected incrementally by a predetermined correction factor DRES', according to the following formulas:

$$RES'=RES'+DRES' \text{ (block 200) or } RES'=RES'-DRES' \text{ (block 400)}.$$

A few preferred embodiments of the disclosure have been described herein, but of course many changes may be made by a person skilled in the art. For instance, in estimating the amount of stock, the condition RES=REF_RES is arbitrarily associated to the condition RES>REF_RES but, of course, it could be associated to the condition RES<REF_RES in a completely equivalent manner. Moreover, although the amount of yarn loaded is calculated on the basis of the speed of rotation and/or the position of the motor in the above-described embodiments, in a way known per se it could also be measured by sensor means, similarly to the measurement of the amount of yarn unwound.

What is claimed is:

1. A stock-controlling method for a storage yarn feeder, said yarn feeder being provided with a drum which is driven to rotate by a motor controlled by a control unit for drawing yarn from a reel and winding it upon itself in the shape of a plurality of loops forming a stock, in which said control unit:

estimates the stock on the drum on the basis of an information indicative of the amount of yarn which is unwound from the drum upon request from a downstream machine, and of an information indicative of the amount of yarn which is wound on the drum, and retroactively controls said motor to substantially stabilize said stock on a reference value, wherein said control unit also performs a parallel correction routine in which:

compares said stock with said reference value to estimate a stock status $$RES<REF_RES \text{ or } RES>REF_RES,$$

wherein RES is said estimated stock and REF RES is said reference value, compares said estimated stock status with a presence signal generated by sensor means adapted to generate an absolute binary information indicative of the presence/absence of yarn in a monitored area of the drum, and in case of an inconsistency between said estimated stock status and said presence signal, said control unit corrects said stock so that it converges toward said monitored area of the drum.

2. The method of claim 1, wherein, when correcting the stock, said control unit either adds or subtracts a correction value from said reference value, depending on whether said sensor means respectively indicate a presence of yarn or an absence of yarn in the monitored area.

3. The method of claim 1, wherein, when correcting the stock, said control unit either adds or subtracts a correction value to the estimated stock, depending on whether said sensor means respectively indicate a presence of yarn or an absence of yarn in the monitored area.

4. The method of claim 1, wherein said correction value corresponds to a minimum length of yarn which can be wound on or unwound from the drum in a controlled and a measurable manner.

5. The method of claim 1, wherein the processing frequency of said parallel correction routine corresponds to the processing frequency at which said control unit retroactively controls said motor.

6. The method of claim 1, wherein the amount of yarn wound on the drum is calculated based on a speed of rotation or a position of the motor.

* * * * *